US010953459B2

(12) United States Patent
Viscardi

(10) Patent No.: US 10,953,459 B2
(45) Date of Patent: Mar. 23, 2021

(54) RIVETTING APPARATUS FOR ASSEMBLY PLANTS

(71) Applicant: COSBERG S.p.A., Bergamo (IT)

(72) Inventor: Gianluigi Carlo Viscardi, Bergamo (IT)

(73) Assignee: COSBERG S.p.A., Bergamo (IT)

( * ) Notice: Subject to any disclaimer, the term of this patent is extended or adjusted under 35 U.S.C. 154(b) by 5 days.

(21) Appl. No.: 16/324,017

(22) PCT Filed: Jul. 27, 2017

(86) PCT No.: PCT/IB2017/054573
§ 371 (c)(1),
(2) Date: Feb. 7, 2019

(87) PCT Pub. No.: WO2018/029563
PCT Pub. Date: Feb. 15, 2018

(65) Prior Publication Data

US 2019/0176212 A1 Jun. 13, 2019

(30) Foreign Application Priority Data

Aug. 8, 2016 (IT) ..... 102016000083531

(51) Int. Cl.

| | |
|---|---|
| ***B21J 15/14*** | (2006.01) |
| ***B21J 15/02*** | (2006.01) |
| ***B21J 15/12*** | (2006.01) |
| ***B21J 15/32*** | (2006.01) |
| ***E05D 3/14*** | (2006.01) |
| *E05D 5/12* | (2006.01) |

(52) U.S. Cl.
CPC ..... *B21J 15/14* (2013.01); *B21J 15/02* (2013.01); *B21J 15/12* (2013.01); *B21J 15/32* (2013.01); *E05D 3/142* (2013.01); *E05D 5/12* (2013.01); *E05Y 2600/508* (2013.01); *E05Y 2800/45* (2013.01)

(58) Field of Classification Search
CPC ... B21J 15/10; B21J 15/12; B21J 15/14; B21J 15/32; B21J 15/44; B21J 15/02
See application file for complete search history.

(56) References Cited

U.S. PATENT DOCUMENTS 2,465,534 A * 3/1949 Havener ..... B21J 15/02 29/464
3,432,925 A 3/1969 Woolley
6,108,896 A * 8/2000 Gignac ..... B21J 15/10 227/152

(Continued)

FOREIGN PATENT DOCUMENTS

DE 23 60 518 A1 7/1975

OTHER PUBLICATIONS

International Search Report and Written Opinion of the International Searching Authority for International Patent Application No. PCT/IB2017/054573 dated Nov. 13, 2017, 9 pages.

*Primary Examiner* — Christopher M Koehler
(74) *Attorney, Agent, or Firm* — Merchant & Gould P.C.

(57) ABSTRACT

A riveting apparatus (1) is for the application and riveting a rivet (6) to a component (2, 4) of an article (1*a*, 1*b*) being processed in a work region (96) of the apparatus. The riveting apparatus includes a rivet insertion device (30) for the insertion of the rivet into the component and a riveting device (40) for the riveting of the rivet.

12 Claims, 20 Drawing Sheets

(56) References Cited

U.S. PATENT DOCUMENTS

| | | | | |
|---|---|---|---|---|
| 6,855,099 | B2 * | 2/2005 | Hazlehurst | B21C 51/005 29/281.5 |
| 2010/0275433 | A1 * | 11/2010 | Diehl | B23P 19/062 29/514 |
| 2019/0143399 | A1 * | 5/2019 | Kasahara | B25J 13/08 29/525.06 |

* cited by examiner

RIVETTING APPARATUS FOR ASSEMBLY PLANTS

This application is a National Stage Application of PCT/IB2017/054573, filed 27 Jul. 2017, which claims the benefit of Serial No. 102016000083531, filed 8 Aug. 2016 in Italy, and which applications are incorporated herein by reference. To the extent appropriate, a claim of priority is made to each of the above-disclosed applications.

BACKGROUND OF THE INVENTION

The object of the present invention is a riveting apparatus for assembly plants, for example for multicomponent articles, such as hinges. E.g. document U.S. Pat. No. 3,432,925A discloses an apparatus according to the prior art.

In the field of assembly plants of articles, it is essential that the machines are able to produce large volumes in a short time. Only in the presence of these features, in fact, the system cost can be amortized in a short time and the investment can be profitable.

In the field of the manufacture of machines for such plants, therefore, there is a tendency to create ever faster lines, sometimes able to produce tens of thousands of articles a day. It is however essential to minimise waste and obtain articles having optimal functionality.

This is even more evident in the case of assembly of multicomponent articles, in which the components are intended for relative movements, as is the case with hinges, for example for windows and doors, furniture, appliances and the like.

SUMMARY OF THE INVENTION

The object of the present invention is to provide a riveting apparatus that meets the needs of the sector.

BRIEF DESCRIPTION OF THE DRAWINGS

The features and the advantages of the riveting apparatus according to the present invention will appear more clearly from the following description, made by way of an indicative and non-limiting example with reference to the following figures, in which.

DETAILED DESCRIPTION OF THE PREFERRED EMBODIMENT

Figure 1A:
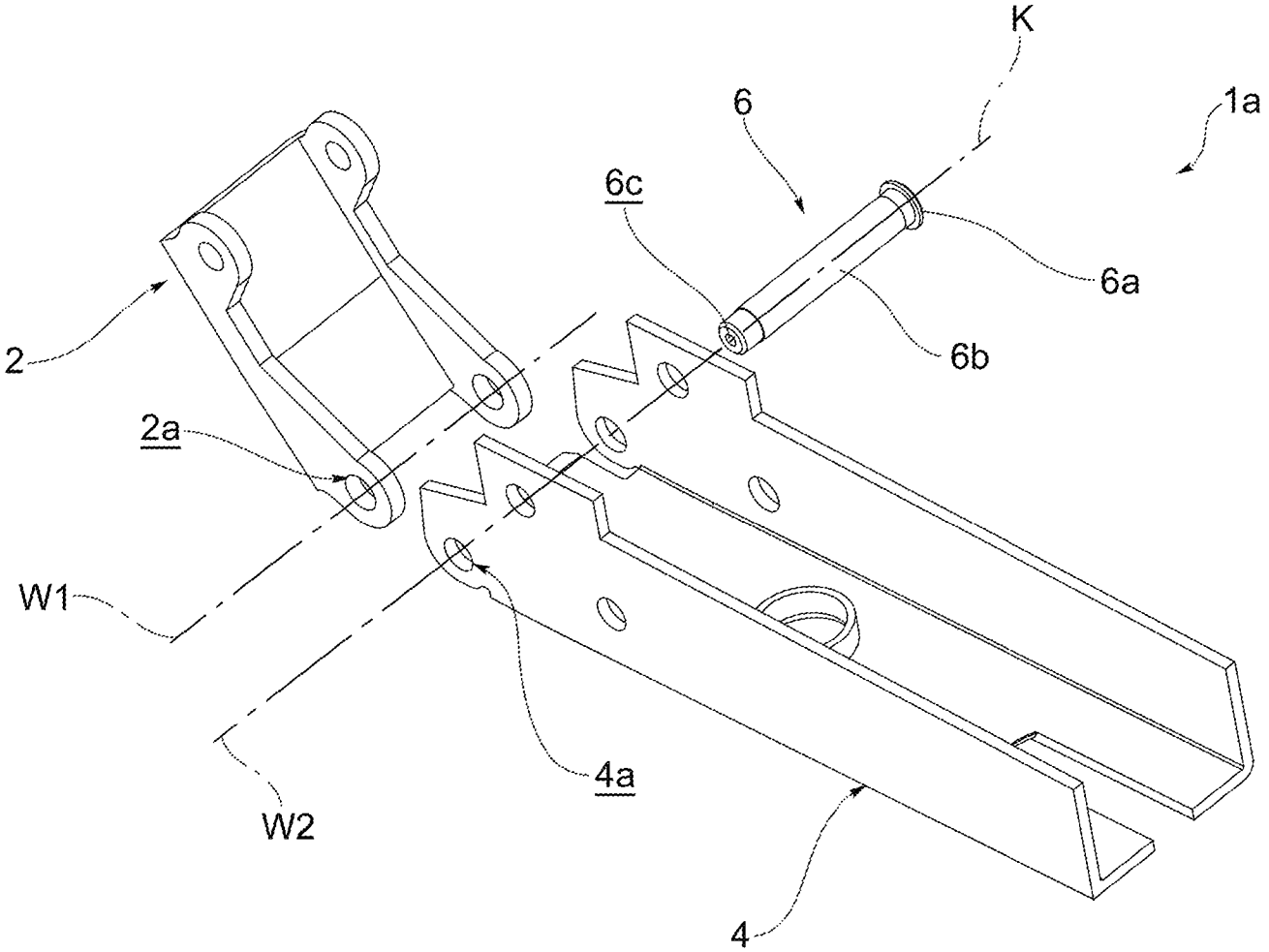
FIG. 1*a* shows a multicomponent article to be riveted and assembled, such as a hinge; the article does not in itself constitute an object of the present invention.

With reference to the example in FIG. 1*a*, reference numeral 1*a* denotes as a whole a multicomponent article to be assembled, for example a hinge, comprising a first component 2 provided with a first through hole 2*a* having a first hole axis W1, a second component 4 provided with a second through hole 4*a* having a second hole axis W2, and a rivet 6 intended to be inserted in the aligned holes 2*a*, 4*a* and engage the first and the second component, thus hinging them.

According to an exemplary embodiment, rivet 6 consists of a head 6*a* to be riveted, i.e. to be plastically deformed, a shank 6*b*, protruding from the head along a rivet axis K, having a slit 6*c* a the free end thereof.

Figure 1B:
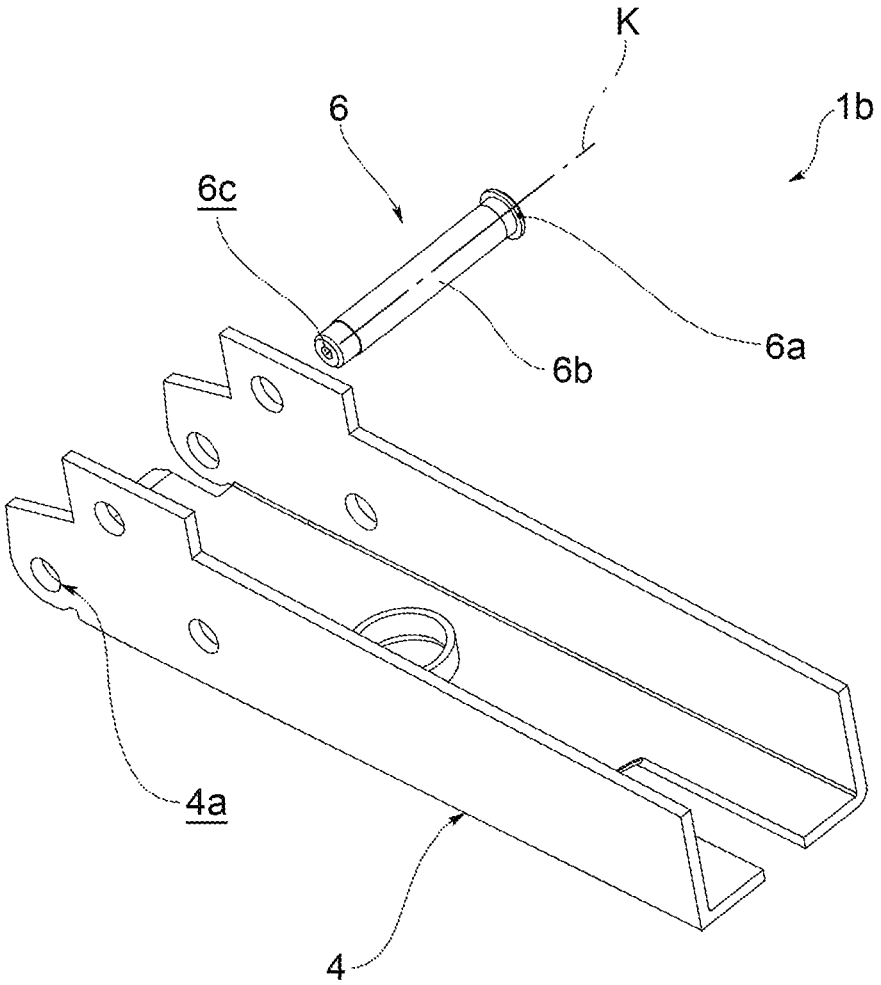
FIG. 1*b* shows an article to be riveted; the article does not in itself constitute an object of the present invention.

FIG. 1*b* shows a further example of article 1*b* to be riveted, consisting of component 4 provided with the through hole 4*a*, to be riveted through rivet 6 intended to be inserted into hole 4*a*.

Figure 2A:
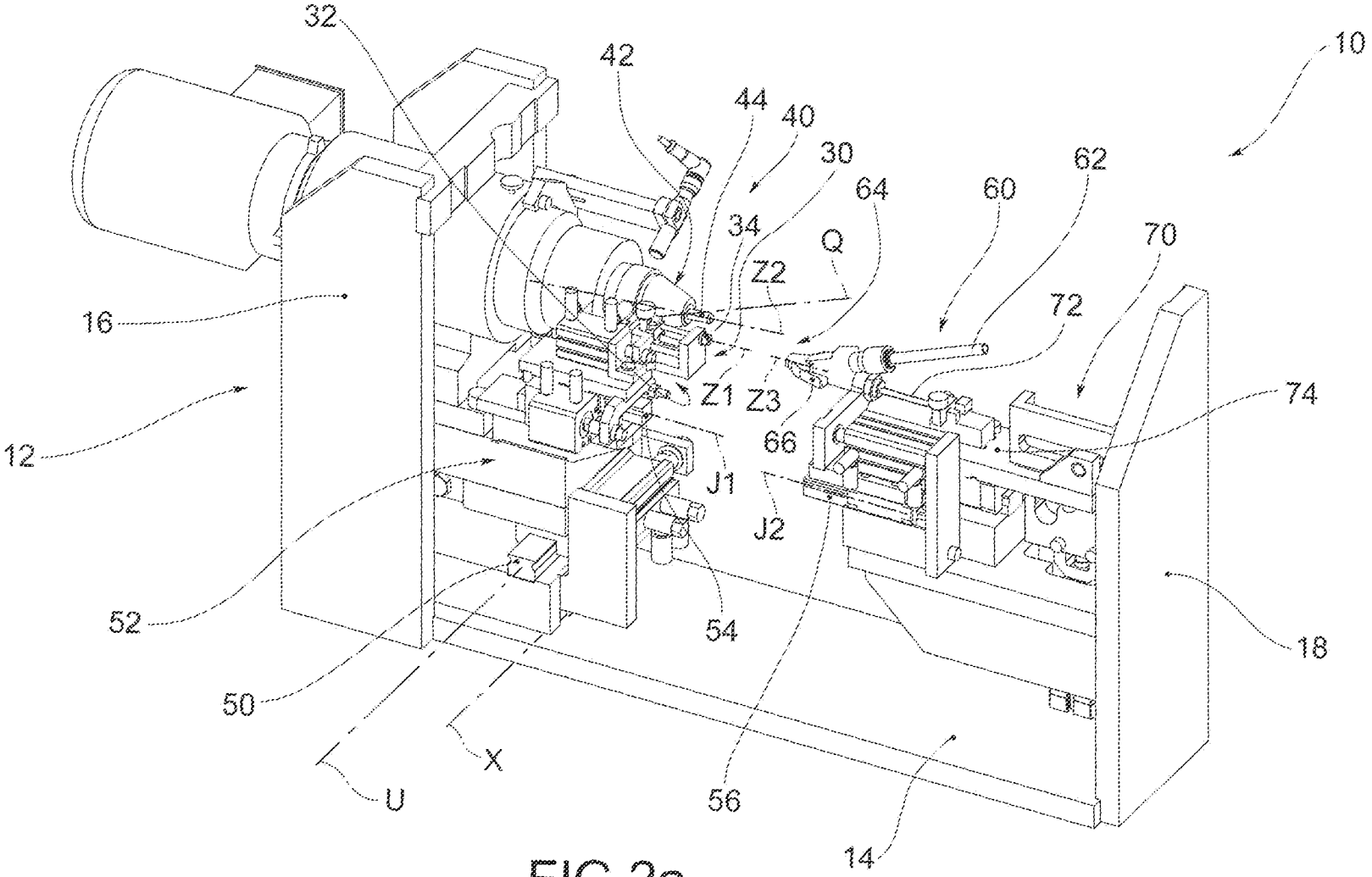
FIGS. 2*a* and 2*b* show a riveting apparatus according to an embodiment of the present invention.
Figure 2B:
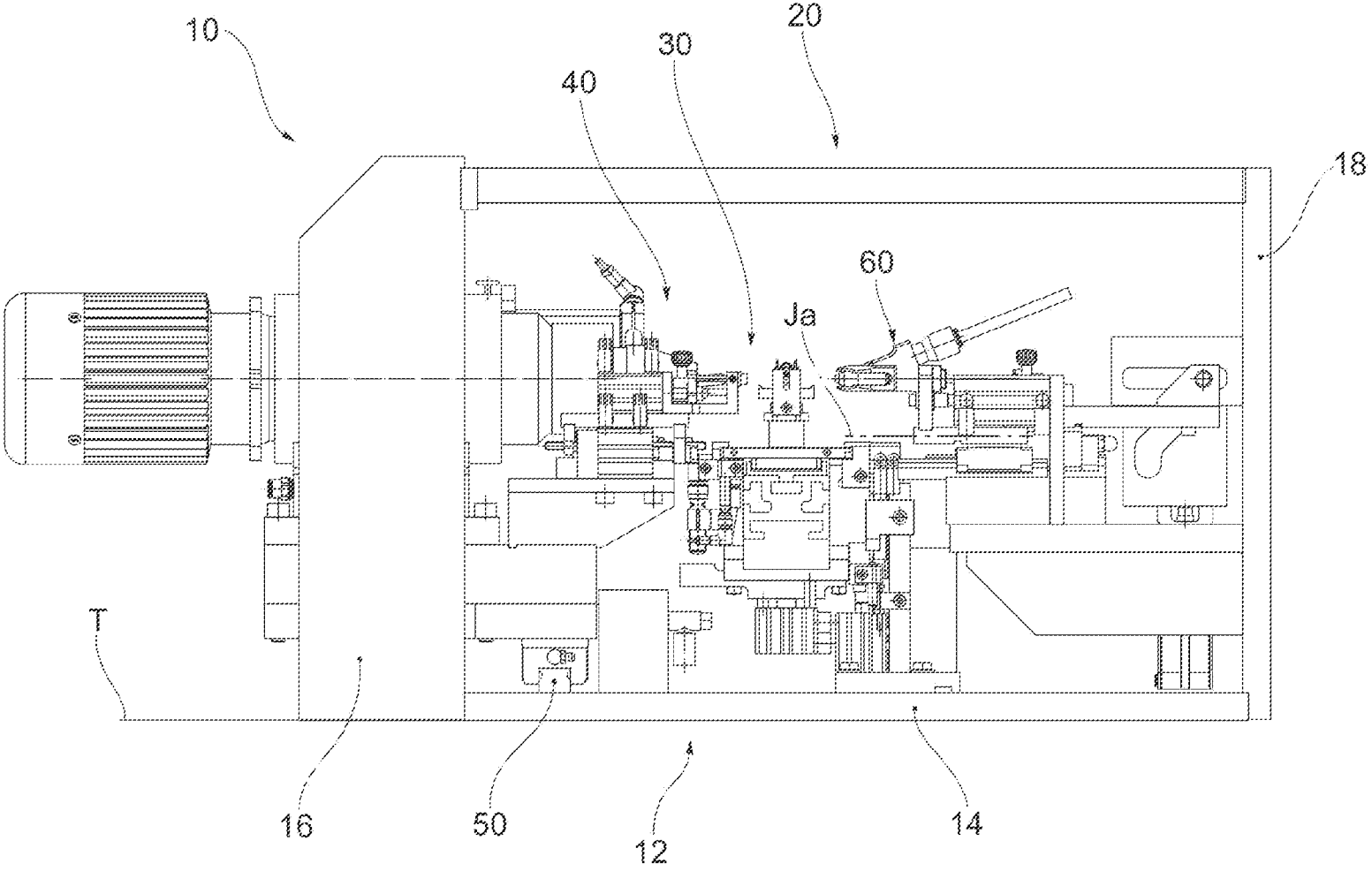

With reference to the embodiment in FIGS. 2*a* and 2*b*, a riveting apparatus 10 comprises a support frame 12 comprising a base 14, resting on a horizontal ground plane T, a first vertical shoulder 16 and a second vertical shoulder 18, supported by base 14 and protruding vertically therefrom, and preferably at least at least one crosspiece 20, which superiorly joins said vertical shoulders panels 16, 18.

The frame thus forms a closed-loop structure, crossed by a transport system, such as a conveyor belt 92 movable along an advancement direction X.

Figure 3A:
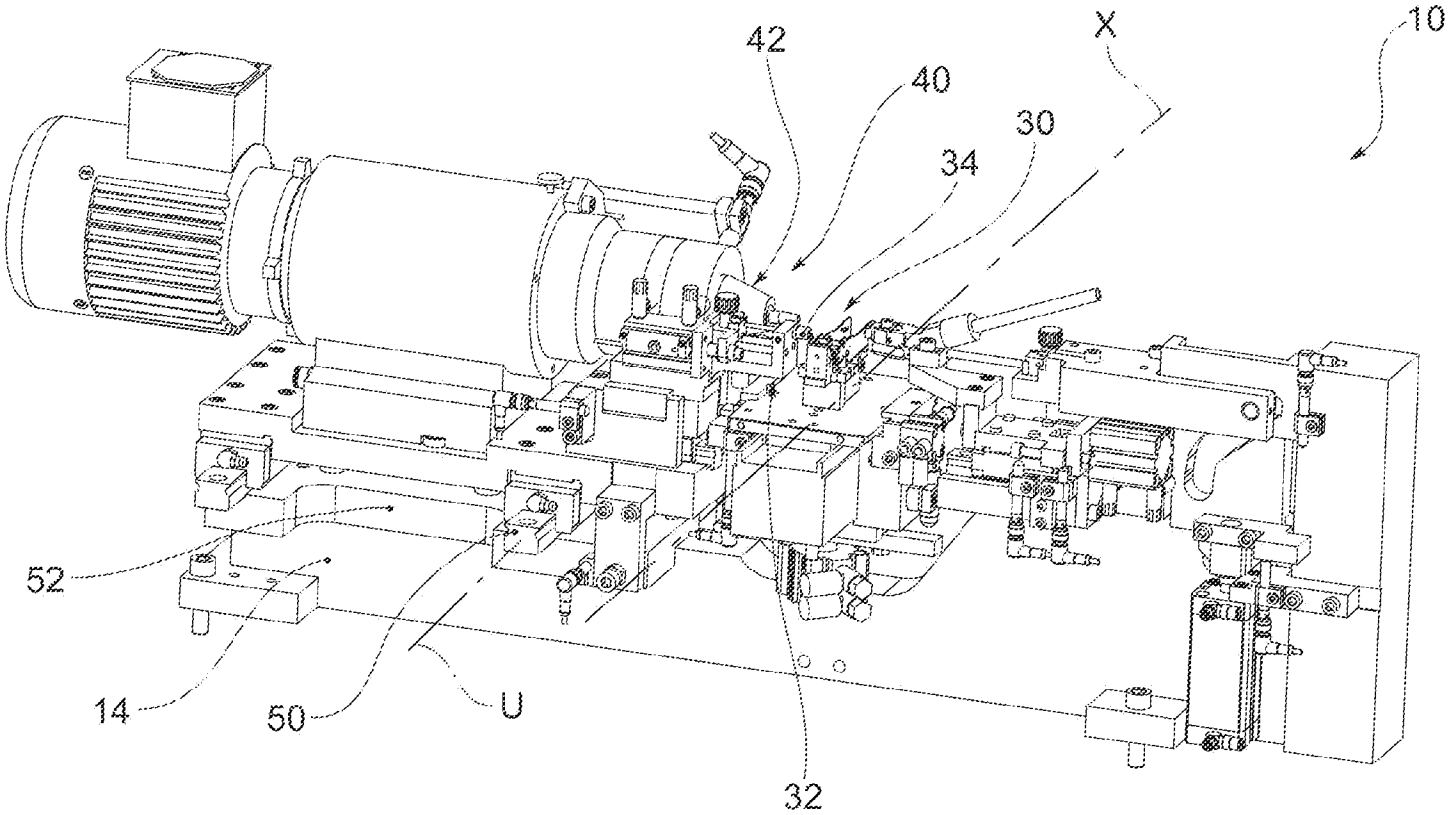
FIGS. 3*a* and 3*b* show a riveting apparatus according to an embodiment of the present invention.
Figure 3B:
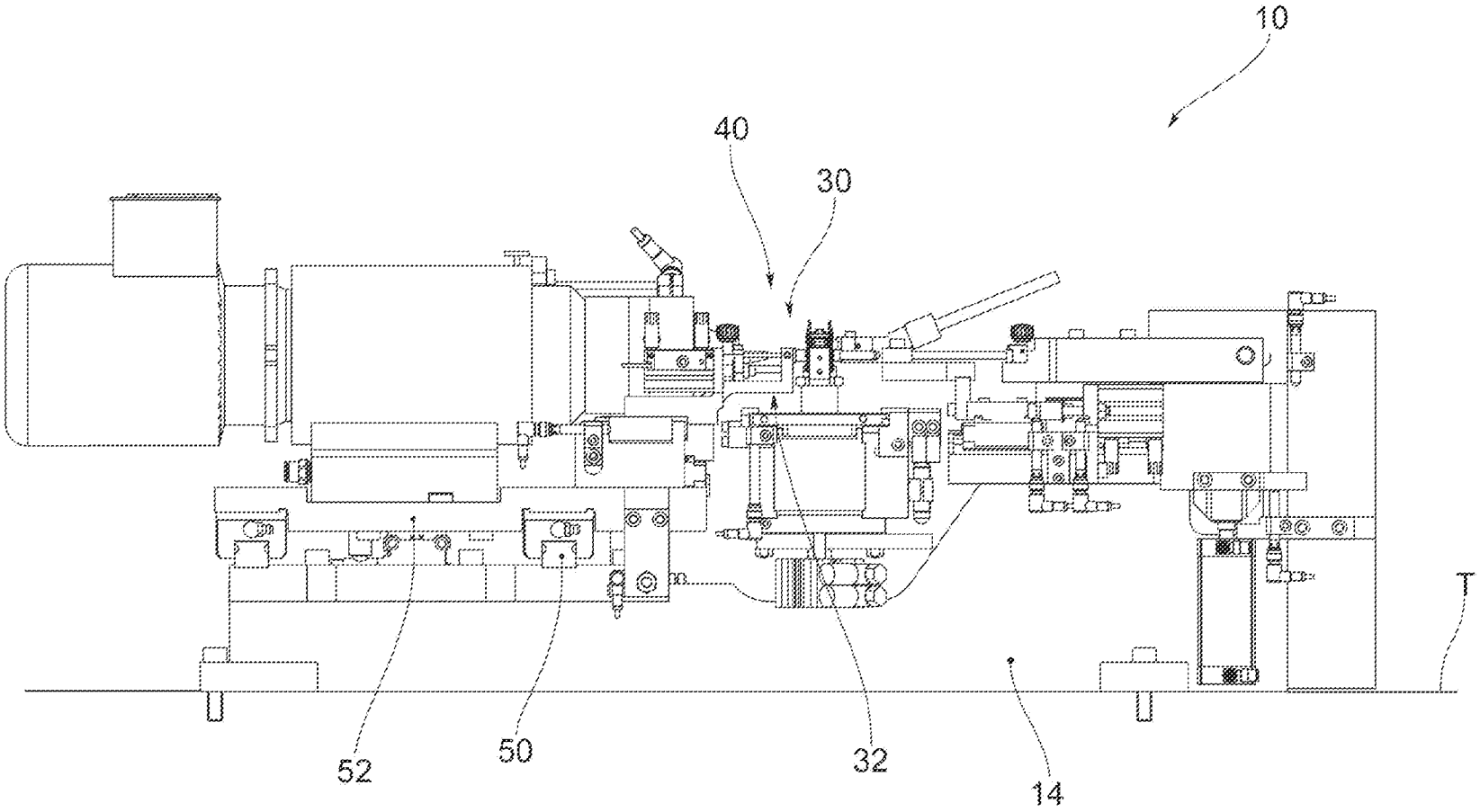

According to a further embodiment (FIGS. 3*a* and 3*b*), the riveting apparatus 10 comprises base 14, resting on the horizontal ground plane T, and an open support structure, crossed by the transport system movable along the advancement direction X.

Moreover, according to the invention, the riveting apparatus 10 comprises a rivet insertion accompanying device 30 for accompanying the insertion of the rivet 6 into the component 4 and a riveting device 40, mutually integrated.

In other words, the rivet insertion accompanying device 30 for accompanying the insertion of the rivet 6 and the riveting device 40 share certain structural parts and provide coordinated functionalities. In addition, preferably, they are both supported by base 14.

The riveting apparatus 10 comprises a longitudinal guide 50, having extension along a longitudinal direction U, oriented along the advancement direction X (for example, parallel thereto), arranged integral with the base or with one of the two shoulders 16, 18, for example with the first vertical shoulder 16.

The riveting apparatus 10 further comprises a mobile support 52 slidably engaged with the longitudinal guide 50, and first movement means, for example pneumatic, adapted to move the mobile support 52 on said longitudinal guide 50 along the longitudinal direction U.

The insertion accompanying device 30 for accompanying the insertion of the rivet 6 comprises a picking group 32 adapted to accompany the insertion of rivet 6 into hole 4*a*, arranged on board the mobile support 52.

In particular, to this end, the picking group 32 comprises a picking rod 34 that is extendable and translatable along a picking direction Z1.

The riveting device 40 instead comprises a riveting head 42 suitable to plastically deform the free end of rivet 6, also placed on board the mobile support 52, longitudinally flanking the picking group 32.

The riveting head 42 is translatable along a riveting direction Z2 orthogonal to the advancement direction X and comprises a rotatable riveting tip 44, intended to come into contact with the free end of rivet 6.

Preferably, said tip 44 has an extension along a tip axis Q, coincident with the axis of rotation, tilted with respect to the riveting translation direction Z2 of head 42.

According to an embodiment variant, the tip has a projection at the end, preferably rounded, suitable for being at least partially inserted into the rivet slit.

In addition, the riveting apparatus 10 comprises a secondary transverse guide 54, having extension along a transverse direction J1 orthogonal to the advancement direction X, placed on board the mobile support 52 and on which is the picking group 32 is placed, and second movement means, such as pneumatic, suitable for moving the picking group 32 along said transverse direction J1 for a movement of approach of the picking group 32 to article 1*a*, 1*b* being processed.

The riveting apparatus 10 further comprises a rivet feed group 60, such as supported by the second vertical shoulder 18.

The riveting apparatus 10 further comprises a primary transverse guide 56, having extension along a transverse direction J2 orthogonal to the advancement direction X, on which the rivet feed group 60 is slidably engaged, and third movement means, such as pneumatic, suitable for moving the rivet feed group 60 to approach it to article 1*a*, 1*b* being processed.

The rivet feed group 60 comprises a tubular conduit 62 and a jaw group 64 placed at the end of the tubular conduit 62; the rivets are fed in succession to the tubular conduit 62 and pneumatically, they are pushed individually into the jaw group 64.

The jaw group 64 comprises a pair of elastic jaws 66 that clamp the rivet and arrange it so that shank 6*b* is aligned along an insertion direction Z3 orthogonal to the advancement direction X.

Figure 4:
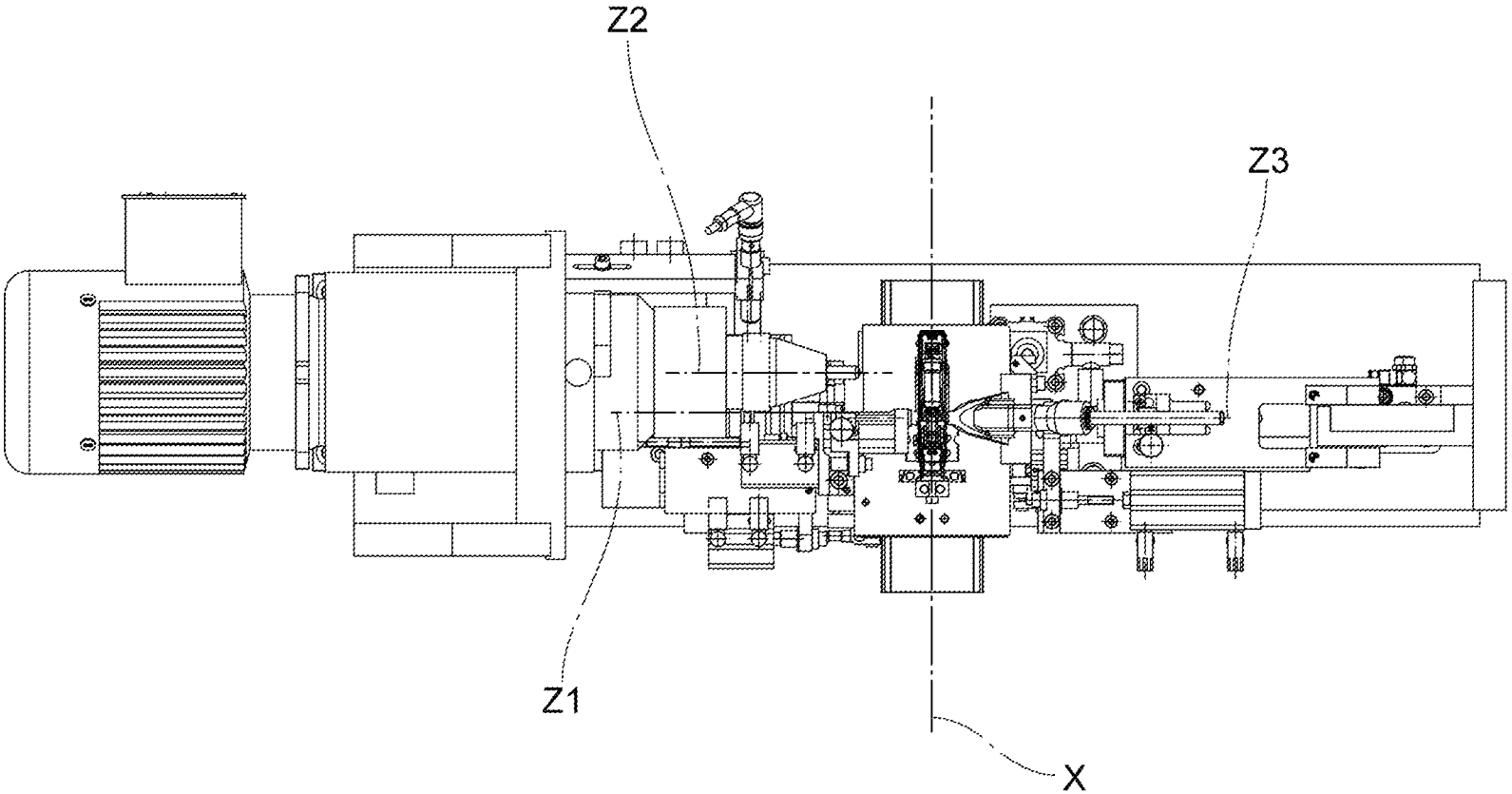
FIG. 4 shows a top plan view of the riveting apparatus according to the invention, in a rivet insertion configuration.
Figure 8:
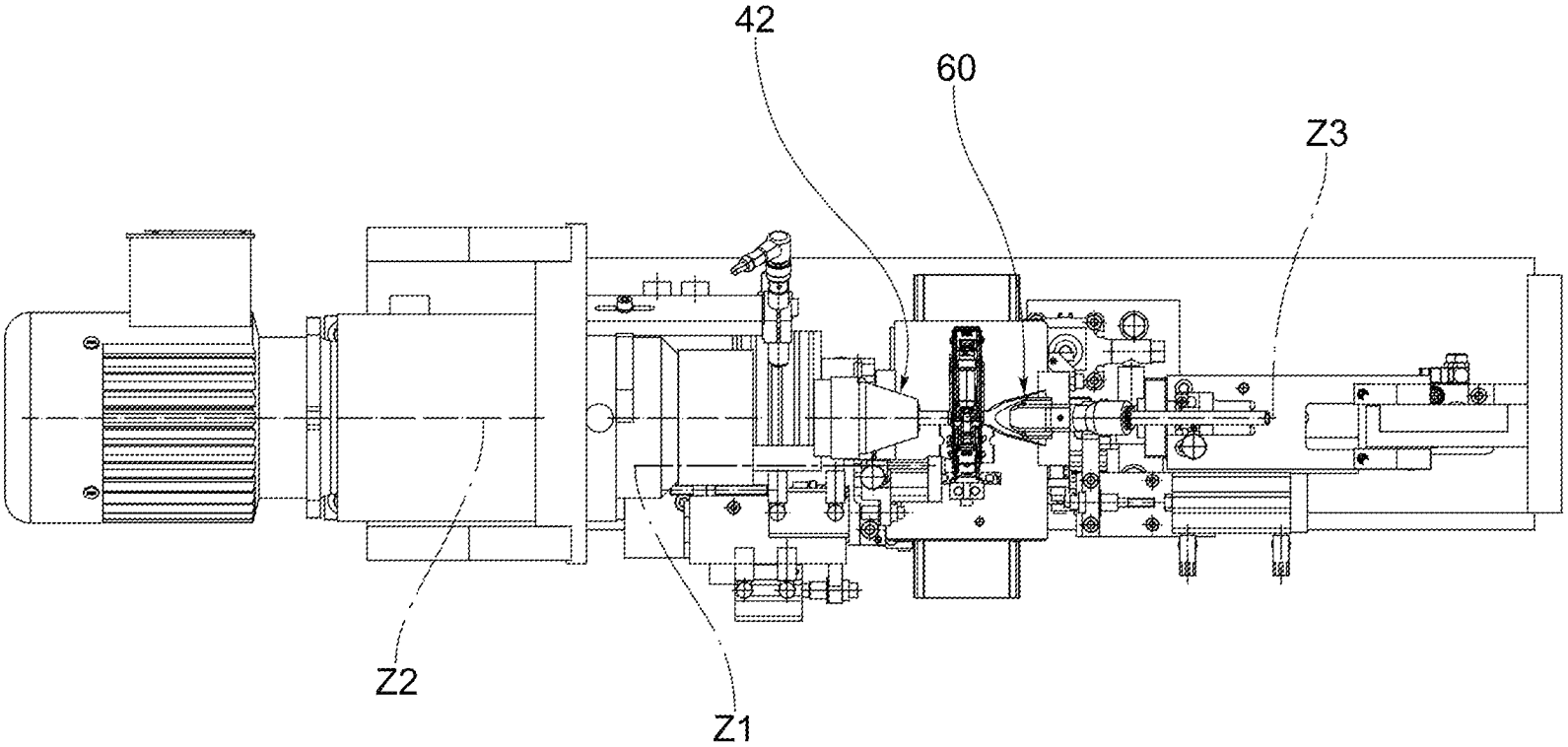
FIG. 8 shows a top plan view of the riveting apparatus in a riveting configuration.

The riveting apparatus 10 is suitable for switching from a rivet insertion configuration to a riveting configuration. In the rivet insertion configuration (FIG. 4), support 52 is in a first longitudinal position, such that the picking direction Z1 is aligned with the insertion direction Z3; in the riveting configuration (FIG. 8), support 52 is in a second longitudinal position, such that the riveting direction Z2 is aligned with the insertion direction Z3.

Moreover, the riveting apparatus 10 comprises an insertion and abutment group 70 cooperating with the rivet feed group 60 for inserting the rivet into hole 4*a* of article 1*b* and with the riveting head 42 for riveting said rivet.

The insertion and abutment group 70 comprises a main rod 72 coaxial to the insertion direction Z3 and translatable along said direction Z3. In particular, the main rod 72 crosses the jaw group 64 and faces towards the region between said jaw group 64 and said picking group 32.

Figure 11:
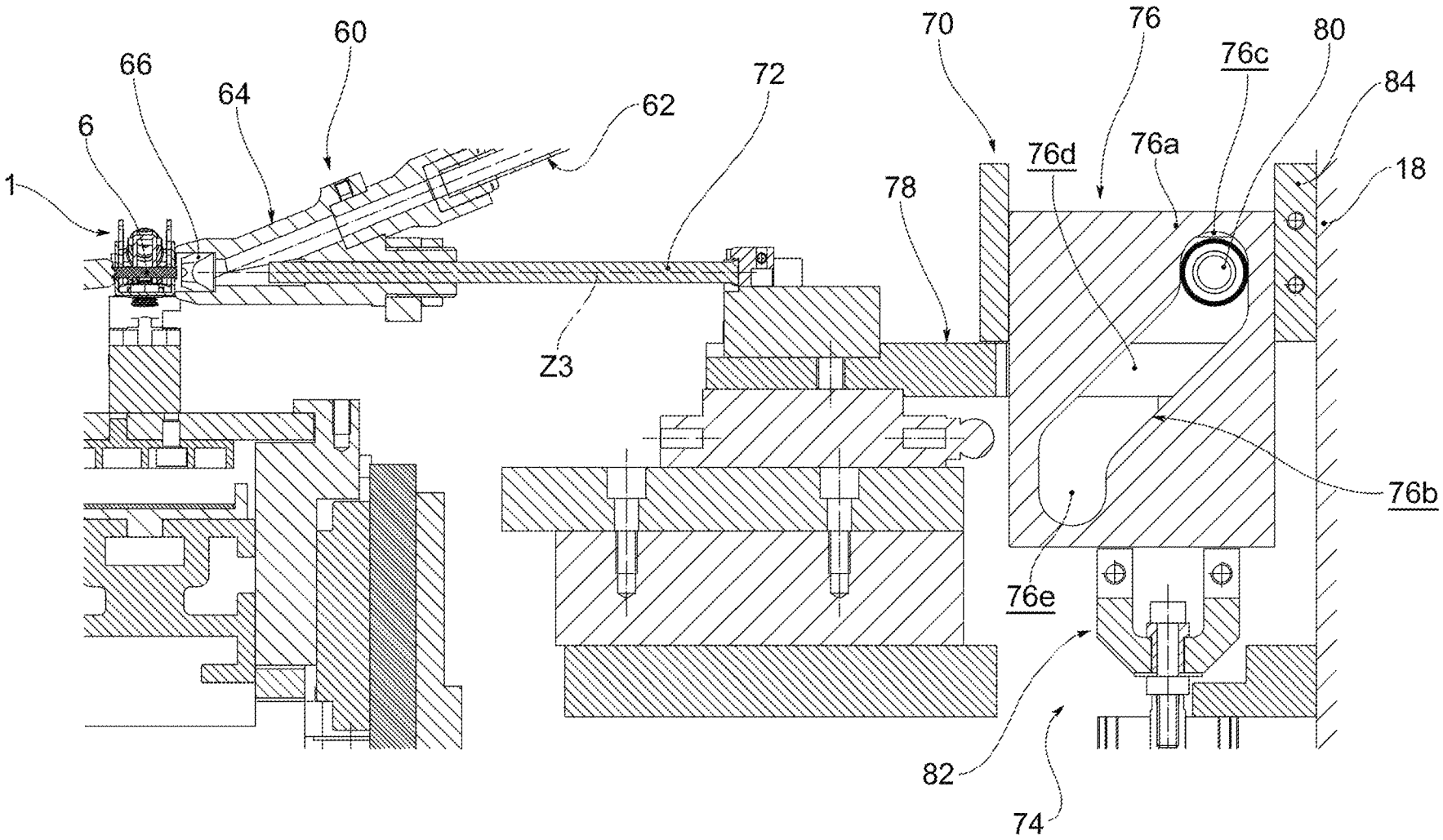
FIG. 11 shows an insertion and abutment group of the apparatus, in a configuration in which a cam is in a first limit position.
Figure 12:
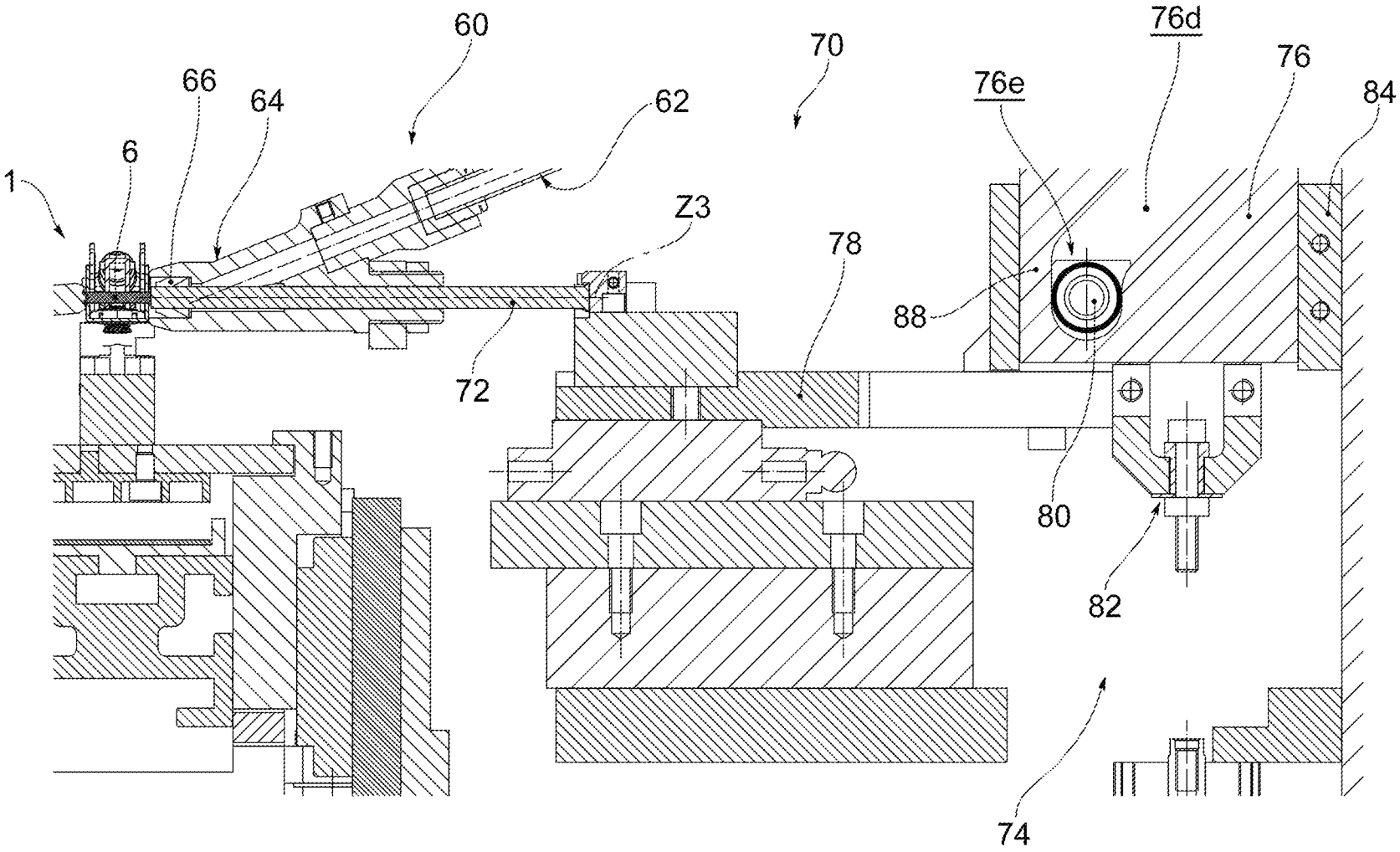
FIG. 12 shows the insertion and abutment group of the apparatus, in a configuration in which the cam is in a second limit position.

According to FIGS. 11 and 12, in order to move the main rod 72, the insertion and abutment group 70 comprises movement means.

For example, said movement means comprise a cylinder-piston group.

According to a preferred embodiment, said movement means are cam movement means 74.

Preferably, said cam movement means 74 comprise a cam 76 and a driven body 78, having an engagement element 80 slidably engaged with cam 76 and integral in an intermediate titled stretch 76*d* and a lower limit compartment 76*e*, in which the engagement element 80 is accommodated when the cam is in the second limit position.

Moreover, the cam movement means 74 comprise actuation means 82, such as pneumatic, for moving cam 76. Preferably, said actuation means are suitable for moving cam 76 vertically.

For example, cam 76 is translatable between a first limit position, such as lowered, which corresponds to a retracted limit position of the main rod 72 (FIG. 11) and a second limit position, such as raised, which corresponds to an advanced limit position of the main rod 72 (FIG. 12).

Moreover, cam 76, in the direction orthogonal to the insertion direction Z3, is in abutment with a fixed shoulder 84, for example with the vertical shoulder 18.

For example, said insertion and abutment group 70 comprises a shoulder 84, with which the cam is in contact and vertically slidable.

Preferably, cam 76 consists of a cam body 76*a*, on which a groove 76*b* is formed in which the engagement element 80 moves integral with the main rod 72.

The shape of groove 76*b* determines the movement features of the main rod 72.

In particular, groove 76*b* comprises an upper limit compartment 76*c*, in which the engagement element 80 is accommodated when the cam is in the first limit position, an intermediate tilted stretch 76*d* and a lower limit compartment 76*e*, in which the engagement element 80 is accommodated when the cam is in the second limit position.

The lower limit compartment 76*e* is delimited in the insertion direction Z3, at the front, by an abutment wall 88 of the cam body 76*a*.

Figure 5:
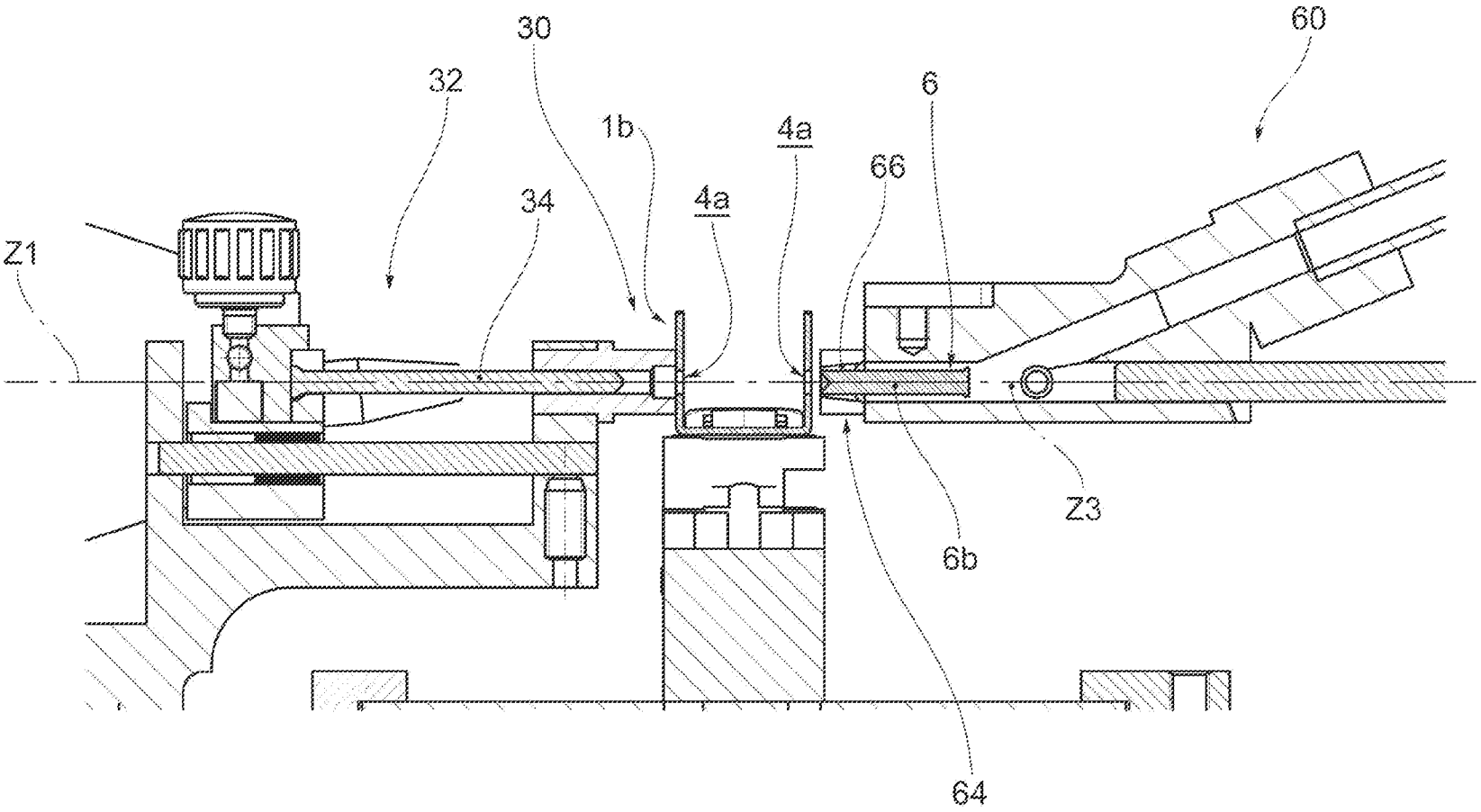
FIGS. 5 to 7 show working steps of the apparatus in the rivet insertion configuration.

In the rivet insertion configuration of the riveting apparatus 10, in an initial configuration of the insertion accompanying device 30 (FIG. 5), the picking group 32 is flanked to article 1*b* being processed, by the actuation of the second movement means that carry out the translation of said picking group 32 along the secondary transverse guide 54, and the picking rod 34 is in an initial retracted position.

At the same time, the rivet feed group 60 is flanked to article 1*b* being processed by the actuation the third movement means that carry out the translation of said rivet feed group 60 along the primary transverse guide 56 and rivet 6 to be assembled is picked by the jaw group 64, so that shank 6*b* is aligned in the insertion direction Z3.

The main rod 72 of the insertion and abutment group 70 is in a retracted limit position, in which it does not engage rivet 6. Therefore, cam 76 is the first limit position (FIG. 11).

Figure 6:
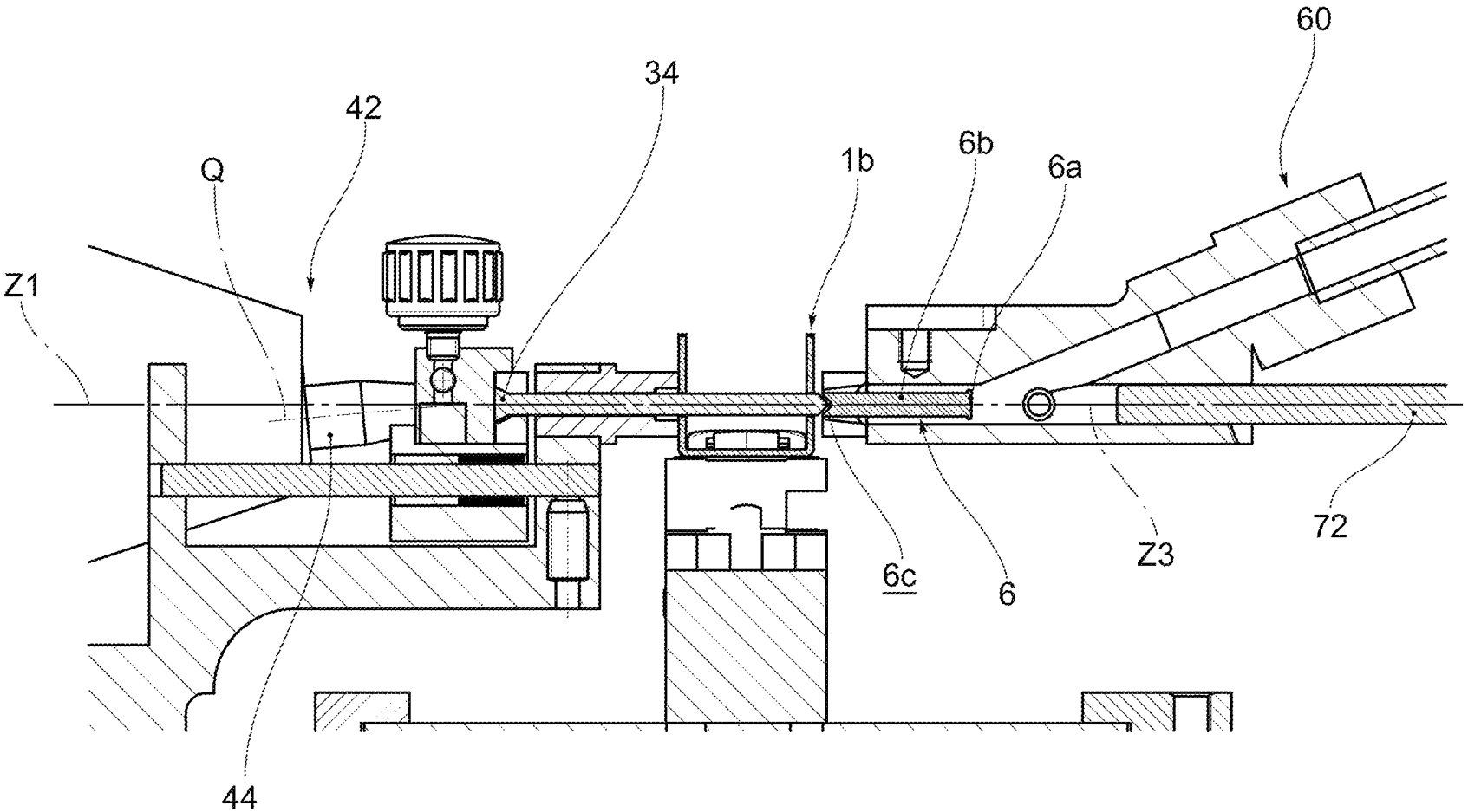

In a subsequent picking start configuration of the insertion accompanying device 30 (FIG. 6), the picking rod 34 is translated to an advanced limit position, in which it crosses the region in which article 1*b* is, in particular so as to cross hole 4*a* and engage rivet 6 on the other side, particularly fitting into slit 6*c* thereof.

Figure 7:
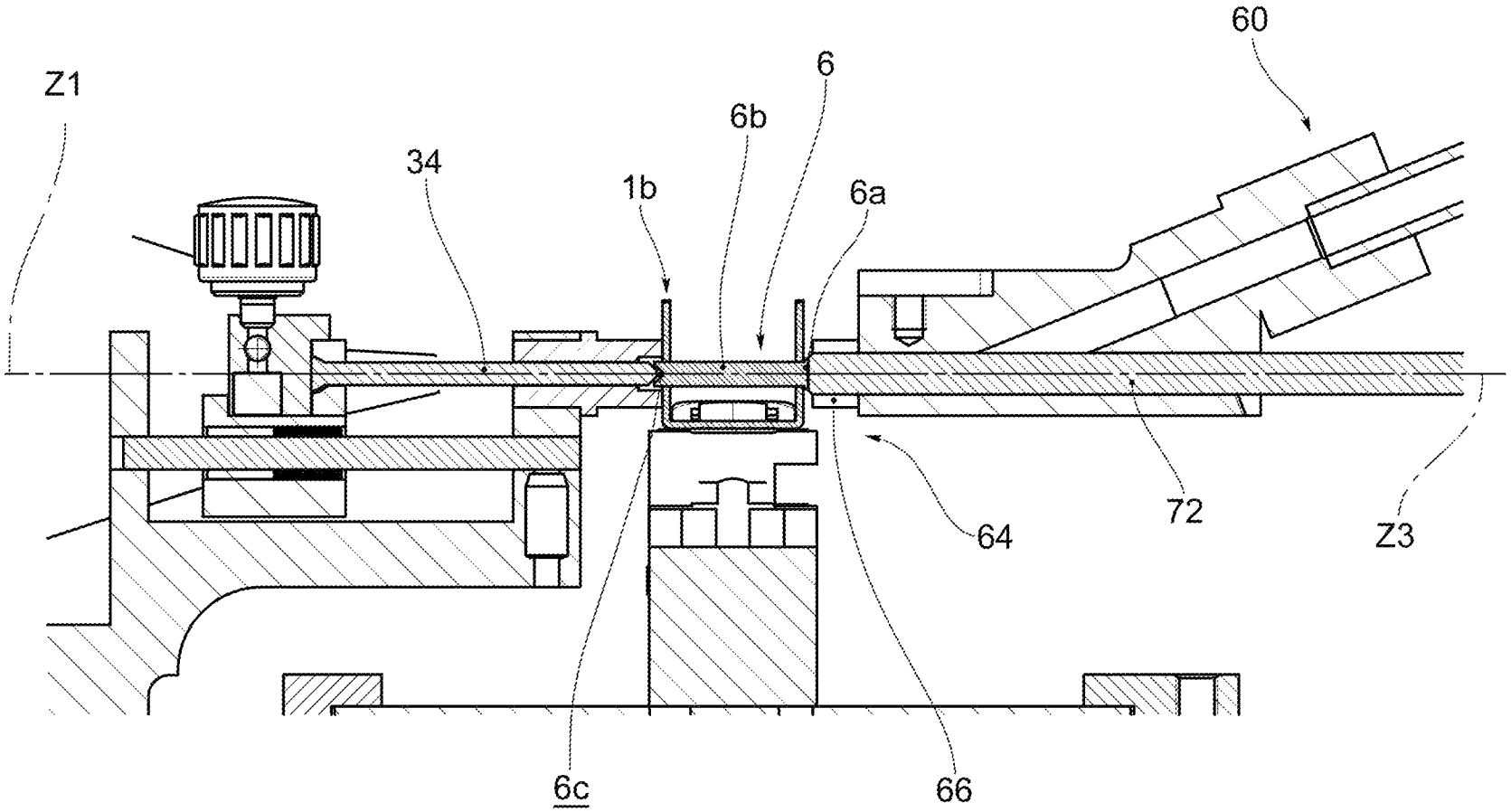

In a subsequent picking configuration of the insertion accompanying device 30 (FIG. 7), the main rod 72 is translated to an advanced limit position and the picking rod 34 simultaneously retracts towards the retracted limit position.

Rivet 6 is thus pushed by the main rod 72 which crossing the jaw group 64 widens jaws 66, allowing the passage of head 6*a* of rivet 6, and simultaneously accompanied through hole 4*a* by the picking rod 34, engaged into slit 6*c*.

Due to the translation of the main rod 72, cam 76 is brought to the second limit position (FIG. 12).

Preferably, the riveting apparatus comprises means for measuring the length of the rivet suitable to provide a measure of the length of the rivet.

According to an embodiment, said measurement means comprise an electronic device for detecting the stroke of the picking rod, an electronic device for detecting the stroke of the main rod and a processing device, operationally engaged with said electronic devices. The electronic device for detecting the stroke of the picking rod detects the forward stroke and the return stroke of the rod, while the electronic device for detecting the stroke of the main rod detects the forward stroke of the main rod. Knowing the distance between the initial retracted position of the picking rod 34 and the limit retracted position of the main rod 72 (which is a constructive parameter), the rivet length can be calculated as a function of the forward stroke of the picking rod, of the return stroke of the picking rod and of the forward stroke of the main rod.

Subsequently, the riveting apparatus 10 switches to the riveting configuration (FIG. 8), in which support 52 is in the second longitudinal position, so that the riveting direction Z2 is aligned with the insertion direction Z3.

Figure 9:
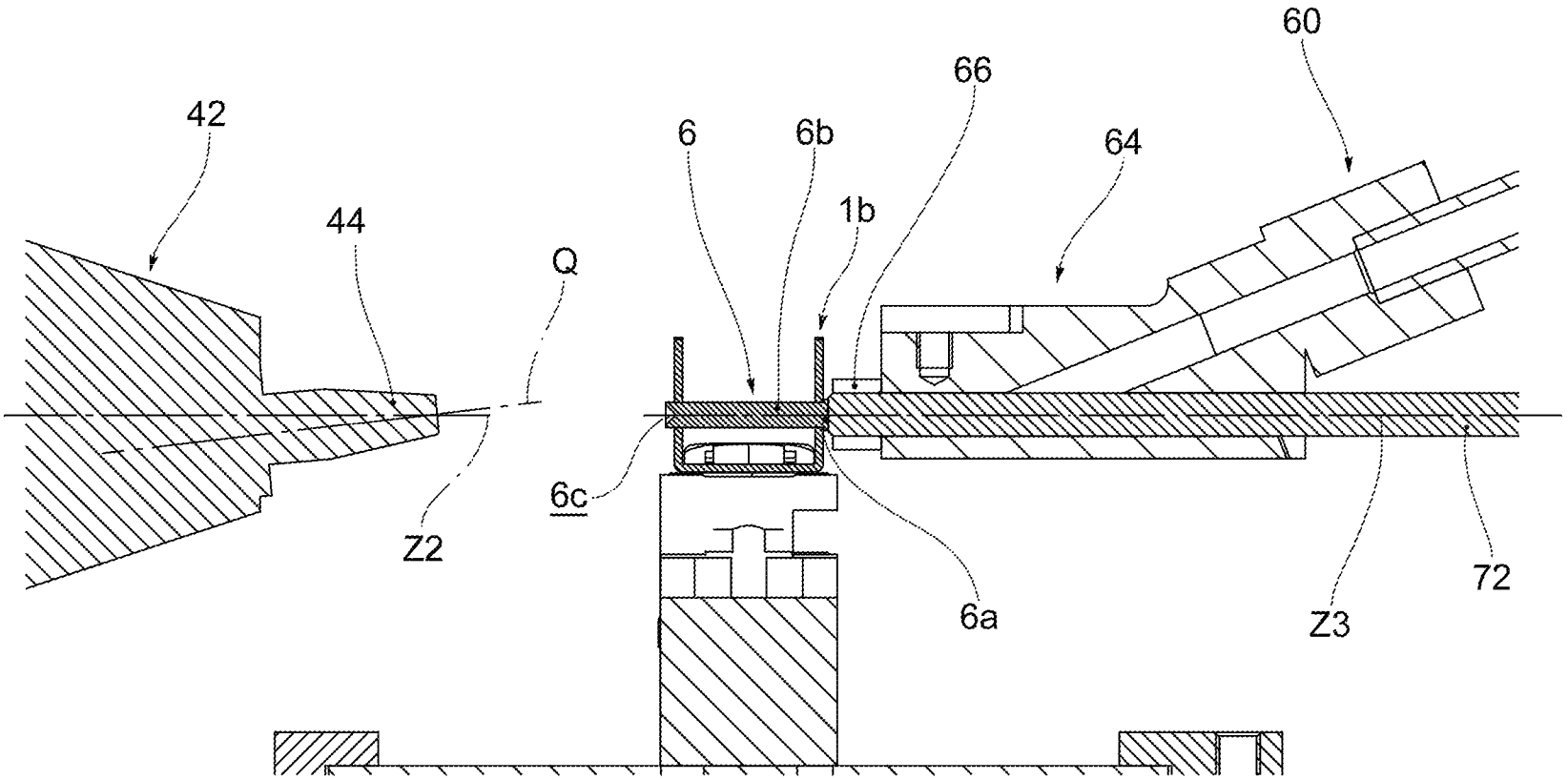
FIGS. 9 and 10 show working steps of the apparatus in the riveting configuration.

In the riveting configuration of apparatus 10, in an initial configuration (FIG. 9), the riveting head 42 is in a retracted limit position, in which it is spaced apart from the region in which article 1*b* is, and specifically spaced from the end of rivet 6.

The main rod 72 remains in the advanced limit position, defined by cam 76 in the second limit position.

Figure 10:
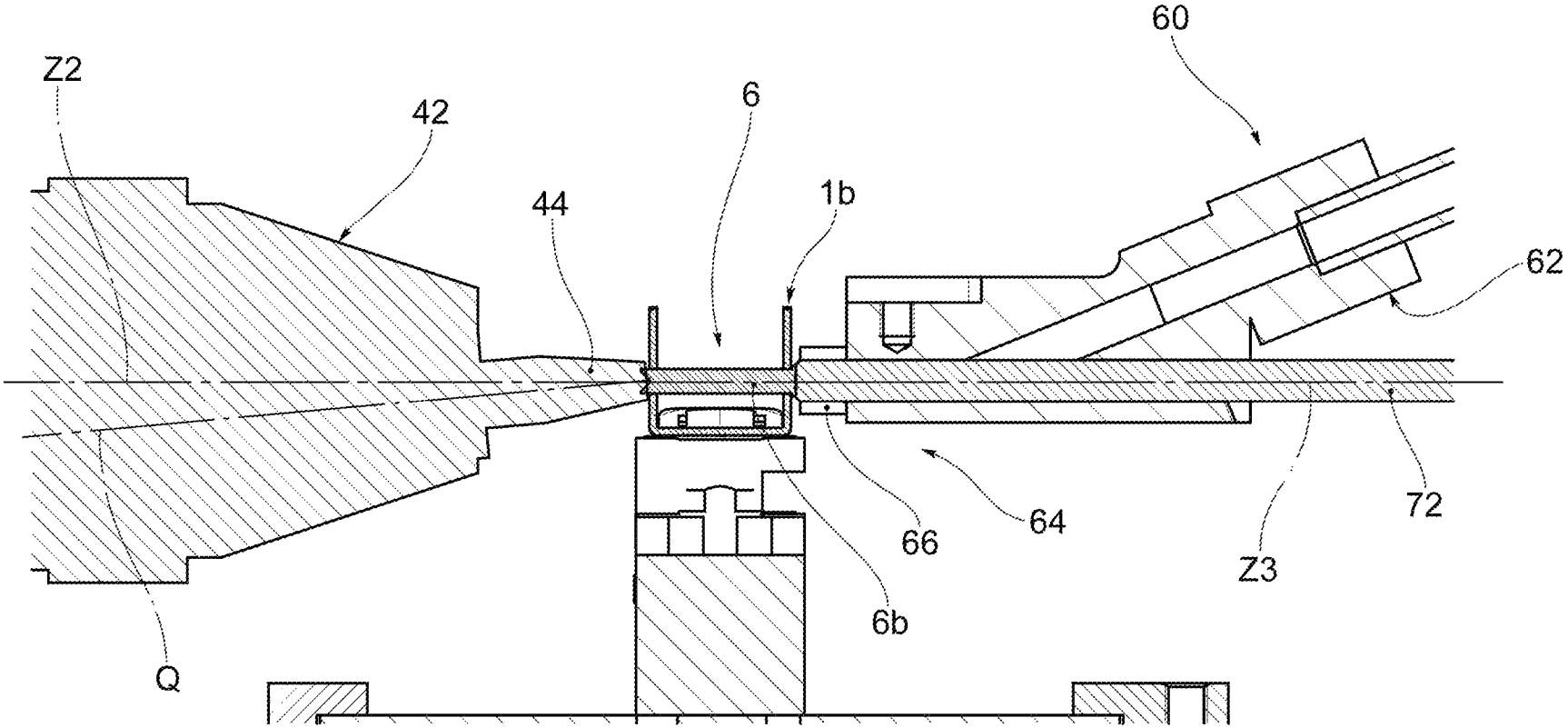

In a subsequent riveting operating configuration (FIG. 10), the riveting head 42 is in an advanced limit position in which it rotates and plastically deform the end of rivet 6, thereby performing the riveting.

During the crushing of the end of the rivet, head 6*a* of rivet 6 is in abutment against the main rod 72, which thus acts as an abutment.

In particular, the action exerted by the riveting head 42 on rivet 6 for riveting is axially transmitted to the main rod 72 and hence to the fixed abutment, such as the vertical shoulder 18, through the driven body 78, the abutment wall 88 of the cam body 76*a* and preferably, shoulder 84.

Alternatively, the cylinder-piston group of the movement means forms an abutment for the main rod.

Preferably, the riveting apparatus comprises means for measuring the hardness of the rivet suitable to provide a measure of the hardness of the rivet.

According to an embodiment, said rivet hardness measurement are suitable for expressing a measure of hardness as a function of the riveting time with the same number of revolutions of the riveting tip or as a function of the current absorbed by the riveting head.

According to a further embodiment, said rivet hardness measurement means comprise a load cell which detects the compression action acting on the rivet.

Figure 13:
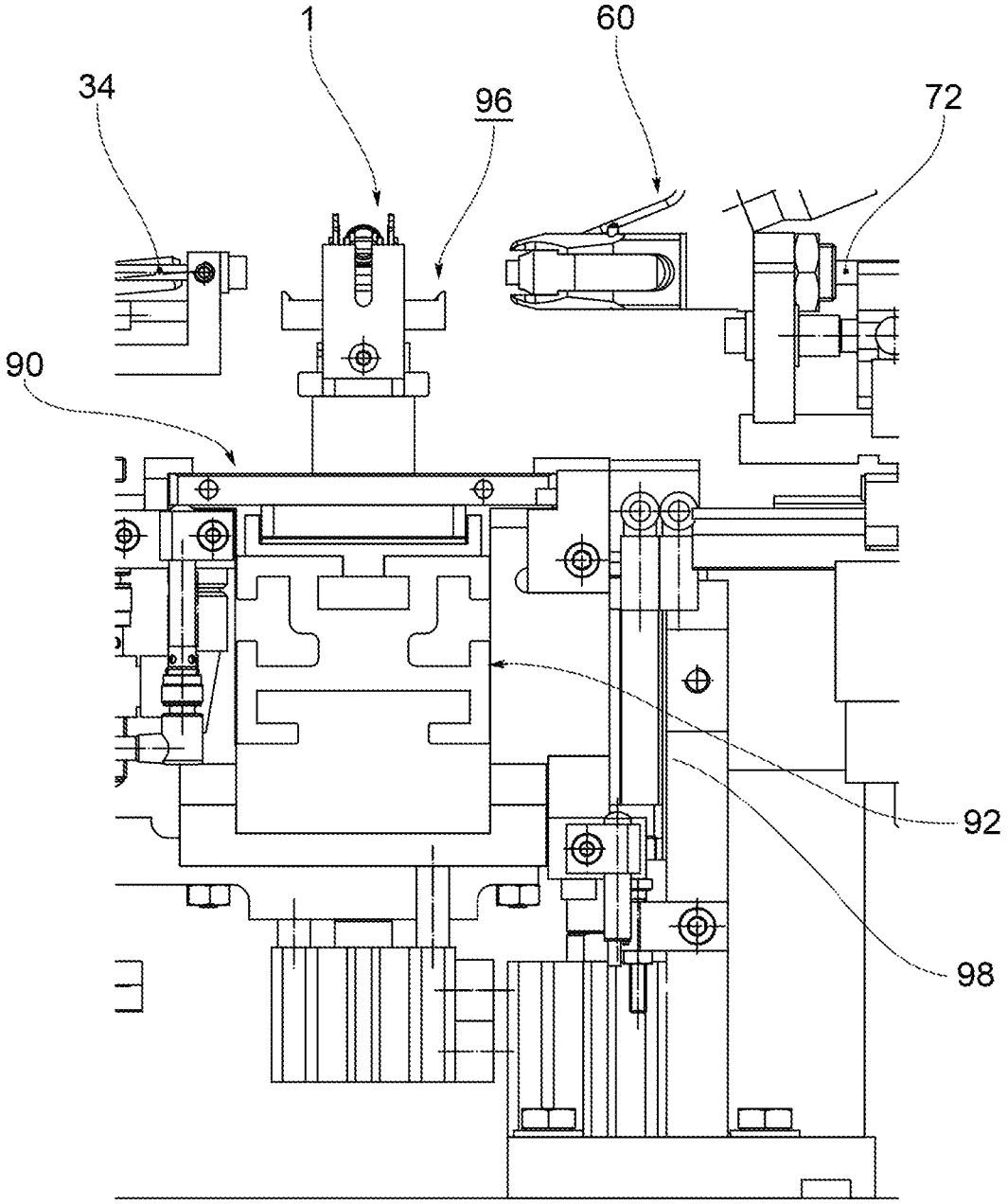
FIG. 13 shows lifting means of the apparatus.
Figure 14:
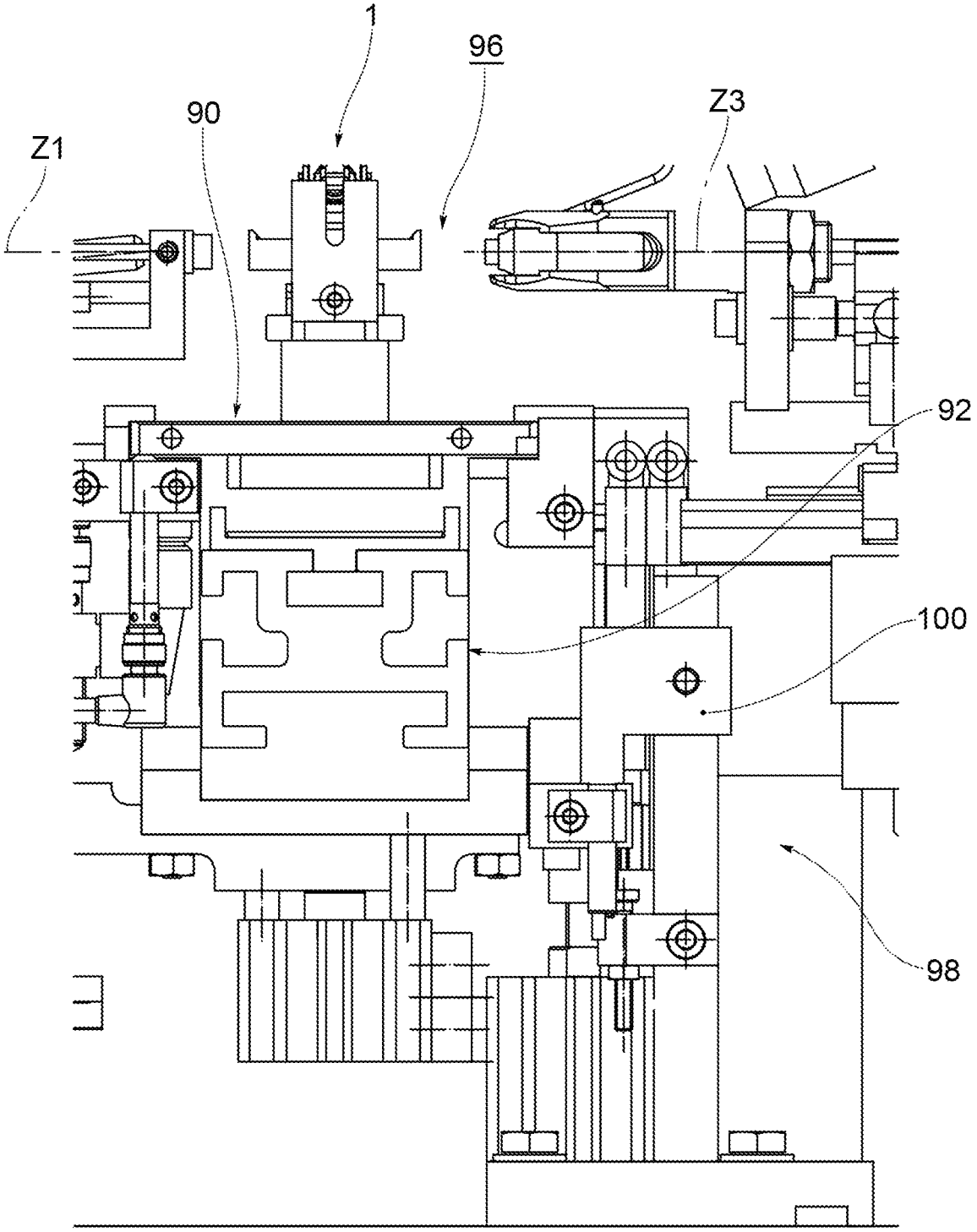
FIGS. 14 and 15 show the lifting means provided with different end stop blocks.
Figure 15:
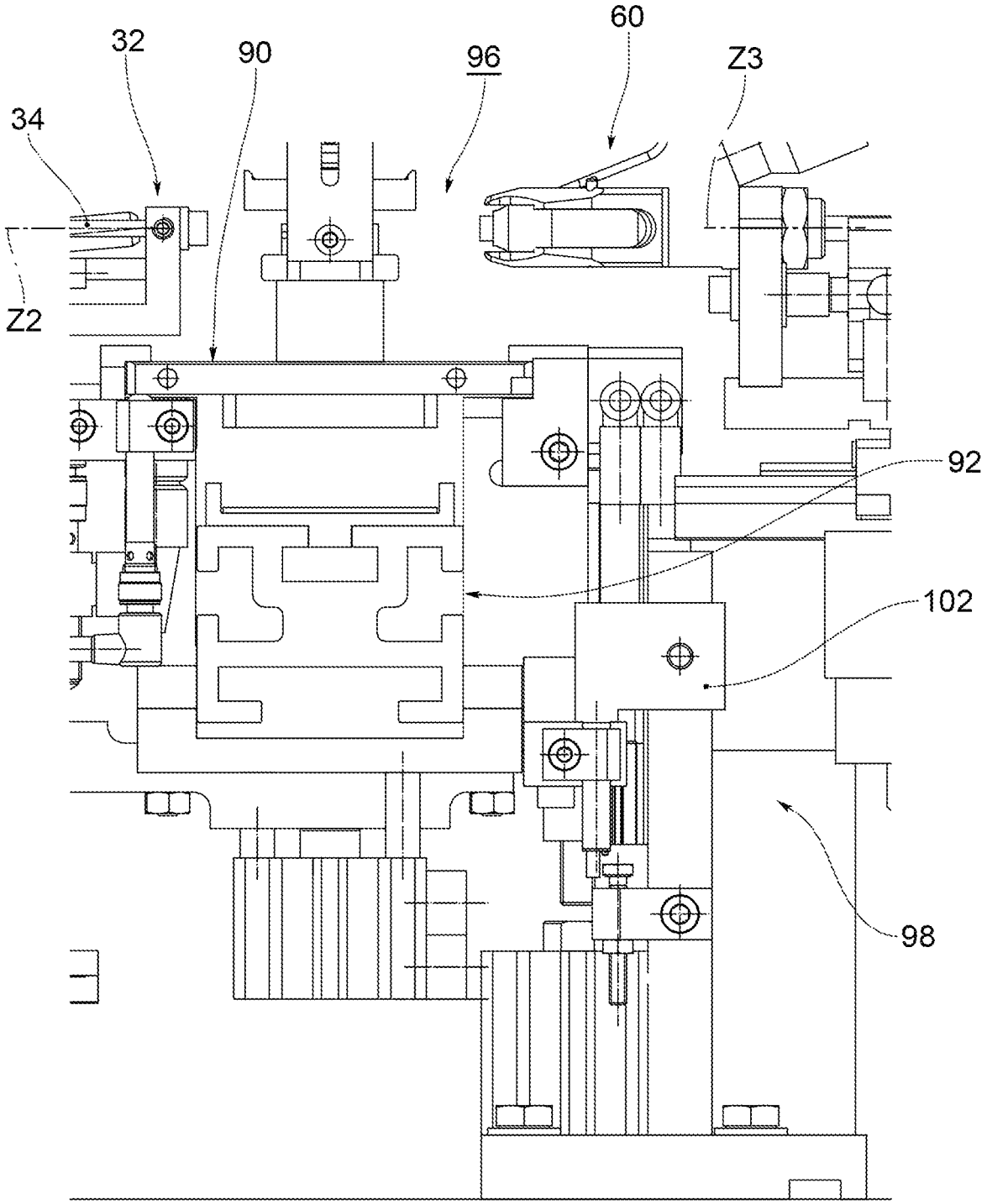

Article 1*b* being processed is moved through the transport system comprising, for example, a pallet 90 of a conveyor belt 92, which moves along said advancement direction X (FIGS. 13, 14, 15).

In order to carry out a predefined assembly step, pallet 90 with article 1 is stationed in a region 96 comprised between the rivet feed group 60 on the one hand and the picking group and the riveting head 42 on the other.

The riveting apparatus 10 preferably comprises lifting means 98 operable to lift pallet 90 to a predefined height.

Preferably, said lifting means 98 are pneumatic and comprise a cylinder-piston group.

Preferably, moreover, said lifting means 98 comprise interchangeable blocks 100, 102 which realise an end stop for said piston, so as to position pallet 90, and thus article 1*b* being processed, so that hole 4*a* is vertically aligned with the picking Z1 or insertion Z3 direction.

Advantageously, this allows assembling products having dimensional differences without performing adjustments on the members of the devices or of the riveting apparatus groups, but simply using the appropriate block 100, 102.

Figure 16:
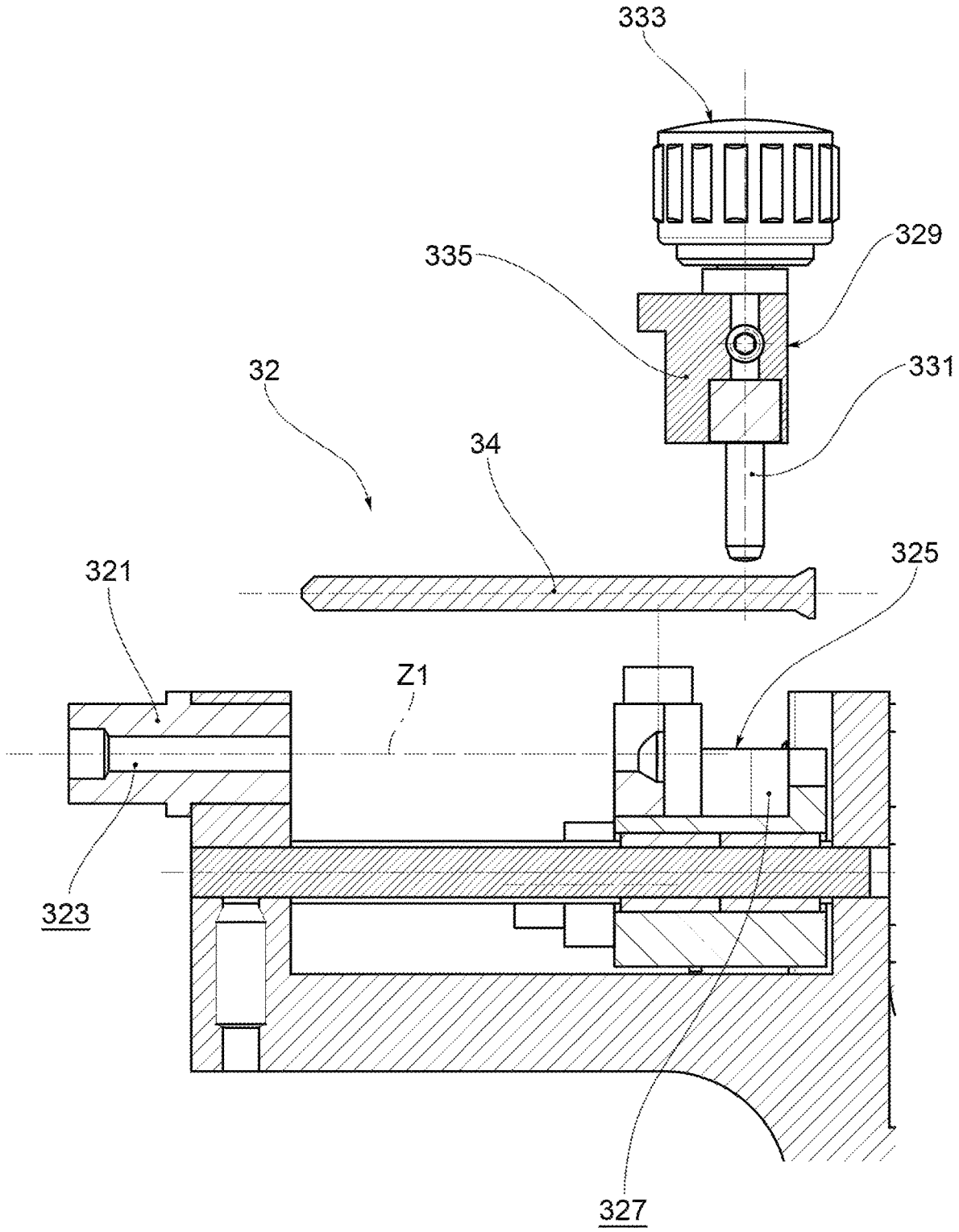
FIGS. 16 and 17 show a picking group of the riveting apparatus according to an embodiment.
Figure 17:
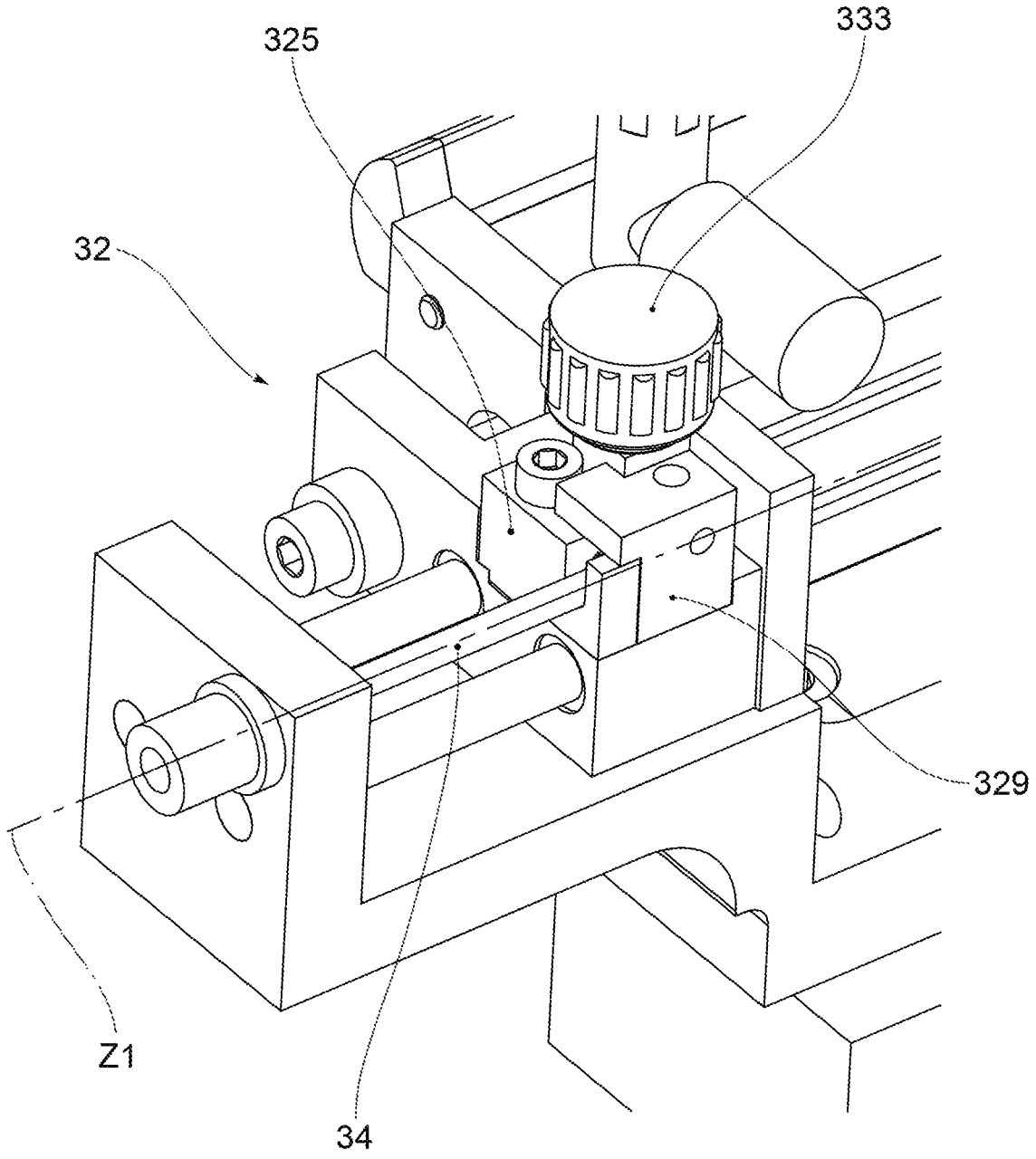

According to a further embodiment (FIGS. 16 and 17), the picking rod 34 of the picking group 32 is replaceable.

In particular, the picking group 32 comprises a bush 321 provided with a through hole 323 which defines the picking direction Z1. In normal operation, the picking rod 34 protrudes from bush 321 towards article 1*b* being processed.

The picking group 32 further comprises a fixed support body 325 provided with a rod seat 327.

The picking rod 34 can be housed, at one end, in the rod seat 327 so as to be inserted into the through hole 323 of bush 321.

Additionally, the picking group 32 comprises a block 329, fixable to the support body 325 via a threaded connection, such as a screw 331 rotatable by a knob 333.

Block 329 has an abutment wall 335 such that, when block 329 is inserted into the rod seat 327, it arranges behind the end of the picking rod 34 so as to realise a fixed abutment.

Advantageously, this allows obviating the damage to which the rod may be subject during a prolonged operation or allows using rods having different length according to the product requirements.

Innovatively, the riveting apparatus according to the present invention overcomes the drawbacks of the prior art as it allows performing rivet insertion and riveting operations at high speed and with excellent accuracy.

Advantageously, moreover, the apparatus has limited dimensions, due to the integration between the rivet insertion device and the riveting device.

According to a further advantageous aspect, the apparatus is particularly strong and reliable, for example due to the closed-loop structure of the frame or for example due to the abutment of the riveting action against a fixed abutment, such as the vertical shoulder.

According to an even further advantageous aspect, the apparatus has a high productivity, as jams or other stops of the device are infrequent, due for example to the rivet being accompanied during the insertion.

It is clear that a man skilled in the art may make changes to the apparatus described above in order to meet incidental needs, all falling within the scope of protection defined in the following claims.

The invention claimed is:

1. A riveting apparatus for application and riveting a rivet to a component of an article being processed in a work region of the apparatus, comprising:

a rivet inserter for inserting the rivet into the component, and comprising a picker provided with a picking rod, the picking rod being extendable and translatable along a picking direction;

riveter for the riveting of said rivet;

a rivet feeder to engage the rivet and position the rivet with a shank along an insertion direction, parallel to a riveting direction and to the picking direction;

wherein said rivet inserter and said riveter are integral and are translatable along a longitudinal direction orthogonal to the picking direction and to the riveting direction and are translatable along said longitudinal direction to alternately align the picking direction or the riveting direction to the insertion direction; and wherein the riveter comprises a riveting head to plastically deform the free end of the rivet and translatable along a riveting direction parallel to the picking direction; wherein the picker and the riveter are arranged on one side of the work region, and the rivet feeder is arranged on the other side of said region.

2. The riveting apparatus according to claim 1, comprising a riveter support translatable along said longitudinal direction, said rivet inserter and said riveter being arranged on board said riveter support.

3. The riveting apparatus according to claim 1, wherein the riveting head comprises a tip having prevailing extension along a tip axis inclined with respect to the riveting direction.

4. The riveting apparatus according to claim 1, comprising a main rod cooperating with the picker for the insertion of the rivet into a hole of the article and with the riveting head for the riveting of said rivet, wherein said main rod is coaxial with the insertion direction and translatable along said insertion direction.

5. The riveting apparatus according to claim 4, further comprising a cam mover for moving the main rod.

6. The riveting apparatus according to claim 5, wherein the cam mover comprises a cam translatable between a first limit position, which corresponds to a retracted limit position of the main rod and a second limit position, which corresponds to an advanced limit position of the main rod.

7. The riveting apparatus according to claim 6, wherein the cam, in the direction orthogonal to the insertion direction, is in abutment with a fixed shoulder applied to a vertical shoulder of a frame.

8. The riveting apparatus according to claim 1, comprising a lift operable to lift a pallet bearing the article to a predefined height.

9. The riveting apparatus according to claim 8, wherein said lift comprises interchangeable blocks forming an end stop for a piston of the lift, to position the article at a desired height.

10. The riveting apparatus according to claim 1, comprising an electronic sensor for measuring a length of the rivet.

11. The riveting apparatus according to claim 1, comprising a load cell for measuring hardness of the rivet.

12. Working A method of using a riveting apparatus, the method comprising:

inserting a rivet in a component of an article being processed, by a picker provided with a picking rod having extension and translatable along a picking direction and a main rod having an insertion direction;

wherein, in a rivet insertion configuration, the picking direction is aligned with the insertion direction;

translating the picker and translating integrally to the picker a riveting head having a riveting direction, so as to align the riveting direction to the insertion direction;

riveting a free end of the rivet by translation of the riveting head along said riveting direction, maintaining the main rod in abutment with a head of the rivet, opposite a riveted end.

* * * * *